US009860655B2

(12) United States Patent
Popovski et al.

(10) Patent No.: US 9,860,655 B2
(45) Date of Patent: Jan. 2, 2018

(54) WIRELESS BINAURAL HEARING SYSTEM

(75) Inventors: Petar Popovski, Aalborg (DK); Peter S. K. Hansen, Smørum (DK)

(73) Assignee: OTICON A/S, Smørum (DK)

( * ) Notice: Subject to any disclaimer, the term of this patent is extended or adjusted under 35 U.S.C. 154(b) by 1067 days.

(21) Appl. No.: 13/281,994

(22) Filed: Oct. 26, 2011

(65) Prior Publication Data

US 2012/0121095 A1 May 17, 2012

Related U.S. Application Data

(60) Provisional application No. 61/414,441, filed on Nov. 17, 2010.

(30) Foreign Application Priority Data

Nov. 17, 2010 (EP) ..... 10191529

(51) Int. Cl.
*H04R 5/00* (2006.01)
*H04R 25/00* (2006.01)

(52) U.S. Cl.
CPC ..... *H04R 25/552* (2013.01); *H04R 25/554* (2013.01); *H04R 25/558* (2013.01); *H04R 2225/55* (2013.01)

(58) Field of Classification Search
None
See application file for complete search history.

(56) References Cited

U.S. PATENT DOCUMENTS 6,768,802 B1 * 7/2004 Baechler ..... H04R 1/00 381/312
2006/0067550 A1 3/2006 Puder et al.
2006/0195522 A1 8/2006 Miyazaki
2006/0251006 A1 11/2006 Oliver
2006/0291680 A1 12/2006 Roeck
2007/0009124 A1 1/2007 Larsen
2007/0133832 A1 6/2007 DiGiovanni et al.
(Continued)

FOREIGN PATENT DOCUMENTS

EP 2200344 A2 6/2010
WO WO 2004/110099 A2 12/2004

OTHER PUBLICATIONS

Haartsen et al., "Blue Tooth: Vision, Goals, and Architecture," Mobile Computing and Communications Review, vol. 2, No. 4, Oct. 1, 1998, pp. 38-45, XP000784002.

*Primary Examiner* — Joseph Saunders, Jr.
*Assistant Examiner* — James Mooney
(74) *Attorney, Agent, or Firm* — Birch, Stewart, Kolasch & Birch, LLP

(57) ABSTRACT

A binaural healing system includes a left-ear hearing device, a right-ear hearing device and an auxiliary device. The auxiliary device has a connected mode wherein it transmits data messages and a disconnected mode wherein it does not transmit data messages, and the auxiliary device is adapted to enable the connected mode in dependence on receiving beacon messages, to synchronize its transmission of data messages with received beacon messages and to enable the disconnected mode in dependence on not receiving beacon messages. To avoid disconnection of the auxiliary device S during gaps, the left-ear hearing device and the right-ear hearing device are adapted to alternatingly transmit the beacon messages.

10 Claims, 4 Drawing Sheets

(56) References Cited

U.S. PATENT DOCUMENTS

| | | | | |
|---|---|---|---|---|
| 2007/0223753 | A1* | 9/2007 | Latzel | H04R 25/552<br>381/312 |
| 2007/0255435 | A1* | 11/2007 | Cohen | H04R 1/1016<br>700/94 |
| 2010/0158292 | A1* | 6/2010 | Pedersen | 381/315 |

* cited by examiner

WIRELESS BINAURAL HEARING SYSTEM

CROSS REFERENCE TO RELATED APPLICATIONS

This nonprovisional application claims the benefit under 35 U.S.C. §119(e) of U.S. Provisional Application No. 61/414,441 filed on Nov. 17, 2010 and, under 35 U.S.C. §119(a) to patent application Ser. No. 10/191,529.6 filed in Europe, on Nov. 17, 2010. The entire contents of all of the above applications is hereby incorporated by reference.

TECHNICAL FIELD

The present invention relates to wireless binaural hearing systems. More specifically, the present invention relates to hearing systems comprising a left-ear hearing device, a right-ear hearing device and one or more auxiliary devices, in which the devices communicate with each other via radio signals.

The invention may e.g. be useful in applications such as providing binaural sound from different sources to a hearing-impaired individual or to a normal-hearing individual.

BACKGROUND ART

US Patent Application 2007/0009124 discloses a hearing aid system comprising a left-ear hearing aid, a right-ear hearing aid and a number of auxiliary devices. The hearing aids and the auxiliary devices together form a wireless network, via which they communicate with each other. Start-up of the network and admission of new devices to the network are controlled by a network master, which engages in an initialisation procedure with the new device(s). The network master is preferably one of the hearing aids, because this device is assumed to be always present on the network.

Objects in a hearing device user's environment disturb the radio signals transmitted and received by the hearing devices, when the hearing devices are in place at or in the user's ears. Consequently, the quality of the wireless communication between the hearing devices and the other devices on the network varies when the user moves his head. Such variations may lead to temporal gaps in the communication, and the duration of the gaps may vary from a few fractions of a second to several seconds or even minutes. The gaps may cause pauses and/or delays in audio signals presented to the user, e.g. during streaming of a television audio signal to the hearing devices. For a user of a binaural hearing system, such pauses and delays may be perceived as if sound sources disappear or shift their locations abruptly, which may be very annoying. Such effects may be even more pronounced, when the pauses or delays affect the left-ear and the right-ear hearing device differently. Furthermore, in a hearing system which communicates settings of one of the hearing devices to the other hearing device via radio signals, the gaps may cause the hearing devices to become temporarily unsynchronised, which may produce similar or other annoying audible effects.

In connection-based networks, such as the one described in the prior art mentioned above, gaps of longer duration may further lead to devices becoming disconnected from the network. To recover from the effects of such a long gap and allow the disconnected devices to participate on the network again, an initialisation procedure must be executed. The execution of the initialisation procedure may prolong pauses and/or delays in the audio signals presented to the user, thus worsening the problem. The execution of the initialisation procedure may take longer time if several devices become disconnected at the same time, e.g. if the network master is unreachable during a long gap.

DISCLOSURE OF INVENTION

There is therefore a need for a binaural hearing system, which provides a more reliable and/or efficient wireless communication between the hearing devices and auxiliary devices. It is an object of the present invention to provide such a binaural hearing system.

Further objects of the present invention are to provide a hearing device, an auxiliary device and a method, each of which allows a more reliable and/or efficient wireless communication between the hearing devices and auxiliary devices in a binaural hearing system.

These and other objects of the invention are achieved by the invention described in the accompanying independent claims and in the following text.

Further objects of the invention are achieved by the embodiments defined in the dependent claims and in the detailed description of the invention.

In the present context, a "hearing system" refers to a system providing audible signals to at least one of an individual's ears, whereas a "binaural hearing system" refers to a system providing audible signals to both of an individual's ears. Such audible signals may e.g. be provided in the form of acoustic signals radiated into the individual's outer ears, acoustic signals transferred as mechanical vibrations to the individual's inner ears via the bone structure of the individual's head and/or electric signals transferred to the cochlear nerve of the individual. A "hearing device" refers to a device suitable for improving or augmenting the hearing capability of an individual, such as e.g. a hearing aid or an active ear-protection device. An "auxiliary device" refers to a device communicating with the hearing devices and affecting and/or benefitting from the function of the hearing devices. Auxiliary devices may be e.g. remote controls, audio streaming devices, mobile phones, public-address systems and/or music players.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more of the same or other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals and names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
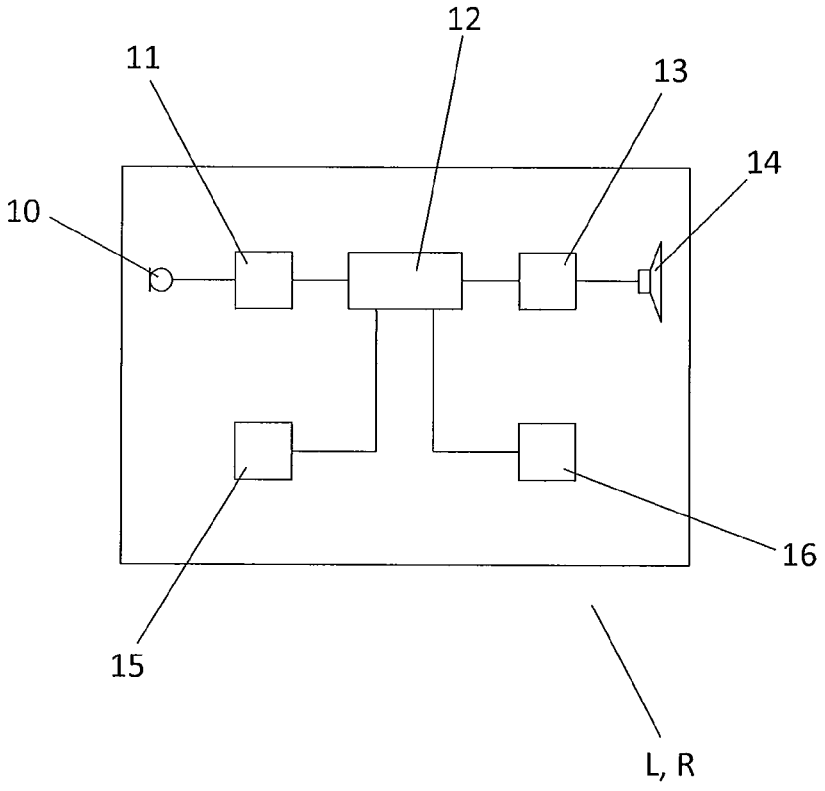
FIG. 1 shows an embodiment of a hearing device, which may be part of a binaural hearing system according to the invention.

The hearing device L, R shown in FIG. 1 comprises a microphone 10, an analog/digital-converter 11, a digital signal processor 12, a digital/analog-converter 13 and a speaker 14 connected in the mentioned order to form an audio signal path.

The microphone 10 is adapted to receive acoustic signals from a user's surroundings and to provide a corresponding electric input signal to the analog/digital-converter 11. The analog/digital-converter 11 is adapted to convert the electric input signal into a digital input signal and to provide it to the digital signal processor 12. The digital signal processor 12 is adapted to process the digital input signal and to provide a corresponding digital output signal to the digital/analog-converter 13. The digital/analog-converter 13 is adapted to convert the digital output signal into an electric output signal and to provide it to the speaker 14, which is adapted to radiate a corresponding acoustic output signal into an ear of the user. The processing within the digital signal processor 12 may comprise e.g. amplification, frequency filtering, level attenuation, level compression, level expansion, voice detection, suppression of acoustic feedback and/or other processing steps known in relation to hearing devices such as e.g. hearing aids and/or active ear-protection devices.

The hearing device L, R further comprises a radio transmitter 15, which is adapted to receive application and network output data from the digital signal processor 12 and to transmit corresponding application and network messages within a predefined radio frequency range, and a radio receiver 16, which is adapted to receive application and network messages within the same predefined radio frequency range and to provide corresponding application and network input data to the digital signal processor 12. The radio transmitter 15 and the radio receiver 16 are both connected to the same radio antenna (not shown). The application data and the application messages may comprise audio data, i.e. data that allow a receiving device L, R, S (see FIG. 2) to receive and restore audio signals from other devices L, R, S, B, and/or control data, i.e. various non-audio data, such as settings and status information, that allow a transmitting and a receiving device L, R, S to cooperate with each other. The network data and the network messages comprise data that allow or facilitate control of the network formed by the devices L, R, S. The distinction between application messages and network messages may, however, not be strict, i.e. application messages may also comprise a relatively small amount of network data, and network messages may also comprise a relatively small amount of application data. The digital signal processor 12 is further adapted to decode audio data comprised in the application input data, to process the decoded audio signal and to incorporate the processed audio signal in the digital output signal provided to the digital/analog-converter 13. This allows the user to hear audio signals received from a remote device L, R, S, B (see FIG. 2). The hearing device L, R may comprise a dedicated control processor (not shown), which is adapted to perform any or all of the functions of generating and decoding the application and network data, controlling the radio transmitter 15 and the radio receiver 16 as well as controlling other parts of the hearing device L, R, thereby relieving the digital signal processor 12 of these tasks. In this case, the digital signal processor 12 may be optimised for audio signal processing only. The radio transmitter 15 and the radio receiver 16 may be combined in a single radio transceiver unit (not shown).

Figure 2:
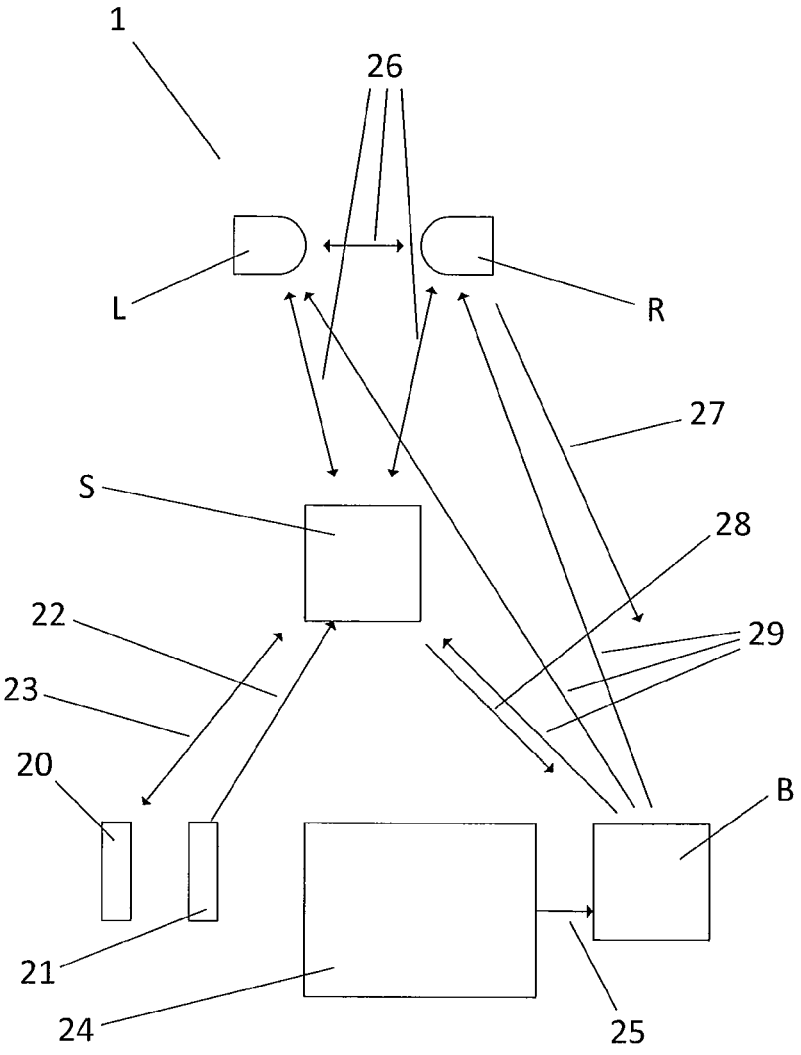
FIG. 2 shows an embodiment of a binaural hearing system according to the invention.

The binaural hearing system 1 shown in FIG. 2 comprises a left-ear hearing device L, a right-ear hearing device R, a streamer S and a TV-box B. The hearing devices L, R are preferably of the type shown in FIG. 1. The streamer S is an auxiliary device, which is adapted to receive audio signals from sources external to the system 1, such as a wireless microphone (not shown), a mobile phone 20 or a telecoil system 21, and to transmit the audio signals via radio to the hearing devices L, R. The streamer S is further adapted to receive audio signals via radio from the hearing devices L, R and to transmit the audio signals to external devices, such as a mobile phone 20. The external signal sources 20, 21 may communicate with the streamer S via wires, as illustrated by the arrow 22, or via wireless links 23, such as e.g. Bluetooth radio or low-frequency radio signals. The streamer S may further serve as a wireless remote control for the hearing devices L, R and transmit corresponding commands to as well as receive status and other information from the hearing devices L, R via radio. The TV-box B is an auxiliary device, which is adapted to receive audio signals from a television set 24 and to transmit the audio signals via radio to the hearing devices L, R. The TV-box B communicates with the television set 24 via a wired connection 25. Alternatively, a wireless connection may be used. The auxiliary devices S, B comprise radio transmitters (not shown) similar to the radio transmitter 15 in the hearing devices L, R. The streamer S further comprises a radio receiver (not shown) similar to the radio receiver 16 in the hearing devices L, R. The radio transmitters and the radio receiver allow the auxiliary devices S, B to communicate with each other and with the hearing devices L, R within the binaural hearing system 1. The devices L, R, S, B transmit audio data and other data, e.g. control data or status information, within a common predefined radio frequency range and as explained in detail further below.

The communication ranges for the individual device combinations within the binaural hearing system 1 differ due to e.g. the different physical locations of the devices L, R, S, B and the different available transmitting power in the devices L, R, S, B. During normal use, the hearing devices L, R are located in or at the user's ears, and the streamer S is typically located on the user's body, e.g. carried in a neck loop. The transmitters 15 and the receivers 16 of the hearing devices L, R as well as the transmitter and the receiver of the streamer S are dimensioned for this arrangement and any of these devices L, R, S may thus normally receive radio signals 26 from any other of these devices L, R, S. The TV-box B is typically located close to the television set 24 and is typically not within reach of the radio signals 27 transmitted by the hearing devices L, R or the radio signals 28 transmitted by the streamer S, which devices L, R, S typically all have relatively little power available for radio transmissions. The TV-box B typically has relatively much power available for transmitting radio signals 29, and these radio signals 29 may thus normally, i.e. in the absence of disturbances, be received by all other devices L, R, S.

The hearing devices L, R and the streamer S may thus communicate bidirectionally with each other, which allows for using a radio protocol with a time-division scheme for media access controlled by one of the hearing devices L, R and with network messages indicating successful and/or non-successful reception of application messages. Each of these devices L, R, S—hereinafter called "aware" devices—may decode the network messages in order to detect missing or damaged application messages or data and retransmit application messages or data that were not received by the intended recipients or that were received with errors. Furthermore, the aware devices L, R, S within the network may adjust their timing to each other, since each of them is typically able to receive messages from all other aware devices L, R, S.

Since the TV-box B, however, is excluded from receiving messages from the hearing devices L, R and the streamer S, it cannot adjust the timing of its radio transmissions to the timing of the other devices L, R, S, and it cannot receive network messages from the other devices L, R, S. Such a device is hereinafter called a "broadcast" device. The communication between the TV-box B and the other devices L, R, S is thus purely unidirectional, and the TV-box B cannot determine whether application messages are received correctly by the other devices L, R, S.

The communication between the hearing devices L, R and the streamer S is connection-based, which means that the streamer S only transmits data when it is in a "connected" mode, in which it thinks itself part of a network controlled by a network master, which may be any one or both of the hearing devices L, R. If the streamer S detects that the connection to the network master L, R is lost, it changes to a "disconnected" mode and stops the transmission of data. The TV-box B, on the other side, being a broadcast device, transmits data whenever it has data to transmit, regardless of there being any other devices L, R, S capable of receiving the data.

Figure 3:
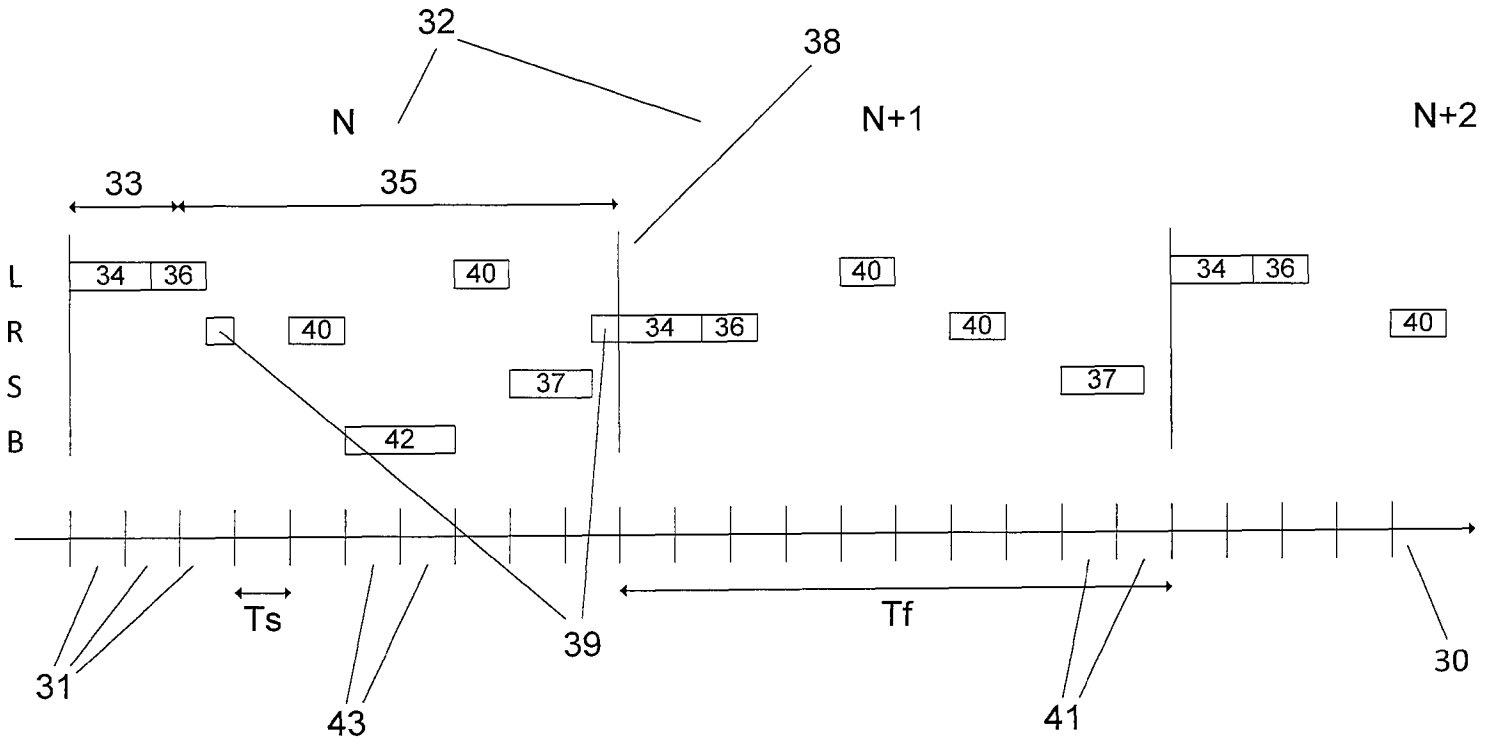
FIG. 3 shows a message sequence illustrating transmission of beacon messages and synchronous transmission of data messages in a first allocation scheme of the binaural hearing system of FIG. 2.

In the example allocation scheme/transmission sequence shown in FIG. 3, the time axis 30 is divided into consecutive time slots 31 of equal duration Ts. The time slot duration Ts is preferably chosen in the range between 50 μs and 500 μs, and more preferably equals about 200 μs. The time slots 31 form the smallest timing reference in the wireless communication network formed by the devices L, R, S. The aware devices L, R, S transmit network and application messages—also called "packets", the start of which normally coincides with the start of a time slot 31. Consecutive frames 32 of duration Tf each occupy an integer number of time slots 31. The frame duration Tf is preferably chosen in the range between 5 ms and 200 ms, and more preferably equals about 50 ms. A beacon interval 33 comprising one or more of the first time slots 31 in each frame 32 is reserved for—or allocated to—transmission of beacon messages 34, whereas the time slots 31 in the remaining portion 35 of the frame 32 are reserved for transmission of data messages 36, 37, 42. Beacon messages 34 are a specific kind of network messages, which mainly comprise network data used for the control of the communication network itself. The start of each beacon message 34 coincides with the start of the corresponding frame 32, which allows other devices L, R, S to derive the frame timing from the time of reception of such beacon messages 34. Data messages 36, 37, 42 may include application messages, which mainly comprise application data, such as sound signal data, device status data and device commands. Data messages 36, 37, 42 may also include network messages other than beacon messages 34.

The hearing devices L, R cooperate to act as a single entity—a "combined" network master—towards other aware devices S in the network. The hearing devices L, R thus control the network timing and the admission of other aware devices S to the network. The hearing devices L, R transmit corresponding data and commands as part of the network data, e.g. in the beacon messages 34. Each frame 32 has a sequence number N, which is increased by one for each new frame 32. The sequence number N of a frame 32 specifies which hearing device L, R shall transmit the beacon message 34 for that specific frame 32. For example, the left-ear hearing device L transmits beacon messages 34 in the even-numbered frames 32, and the right-ear hearing device R transmits beacon messages 34 in the odd-numbered frames 32 or vice versa. The other aware devices S align their frame and slot timing to the received beacon messages 34. The hearing devices L, R repeatedly transmit the sequence number N to inform other aware devices S of the sequence numbers N of each frame 32. The sequence number N of the current frame 32 may be transmitted e.g. as part of the beacon message 34, and e.g. once for each frame 32 or less frequently. The frequency may be varied dependent on the status of the network and e.g. be increased during establishing of new connections with aware auxiliary devices S in order to ensure that such devices S may quickly adapt to the existing frame structure on the network.

Instead of the strict odd/even alternation, other alternating schemes may be used, e.g. two beacon messages 34 transmitted by the left-ear hearing device L followed by two beacon messages 34 transmitted by the right-ear hearing device R. The alternation may also be asymmetric, i.e. with different numbers of consecutive beacon messages 34 transmitted by the two hearing device L, R.

When the communication network is in a state in which both hearing devices L, R are able to receive messages 34, 36, 37 from each other, one of the two hearing devices L, R is the "master hearing device", i.e. the one that controls the timing and other network-related behaviour of the other hearing device L, R, i.e. the "slave hearing device". In the simplest form, the network data transmitted by the slave hearing device L, R may just be a copy of the network data transmitted by the master hearing device L, R, however with the sequence number N properly incremented. Which hearing device L, R is the master and which is the slave hearing device may be a pre-programmed property of the system. For instance, the left-ear hearing device L may always be the master and the right-ear hearing device R always the slave, or vice versa. Alternatively, the master and slave roles may be negotiated during establishing of a connection between the two hearing devices L, R. The master role may e.g. be given to the hearing device L, R which has the larger number of connections to other aware devices S and/or has been switched on for the longer time.

Due to the alternating transmission of beacon messages 34, an aware auxiliary device S, which is only able to receive messages from one of the hearing devices L, R, will still receive network data and commands from the combined network master L, R, however at half rate. The aware auxiliary device S will thus be able to maintain the connection to the network even when one hearing device L, R appears to be absent for a prolonged period of time. The aware auxiliary device S does not need to perform any special actions, such as participating in an initialisation procedure, in order to maintain and/or re-establish the connection to the absent hearing device L, R. In the case that the aware auxiliary device S is e.g. in the process of transmitting data messages 37 comprising real-time audio signals at a high rate when one of the hearing devices L, R apparently becomes absent, the aware auxiliary device S may thus continue the process without delay, so that one, or possibly both, of the hearing devices L, R is/are able to receive and restore the real-time audio signals without pauses or delays.

In the event that the direct communication between the hearing devices L, R is interrupted, each hearing device L, R continues to act as an independent network master, thereby individually performing all of the above mentioned functions of the combined network master. In this case, network data and/or commands may be relayed between the hearing devices L, R by other aware devices S in order to maintain compatibility and/or synchronisation of the frame timing and other network properties, such as e.g. a frequency hopping scheme, time slots 31 reserved for transmission of specific kinds of data messages 36, 37, 42 and/or by specific devices L, R, S, B, etc. Such network properties are described in more detail further below. When the interruption ends, the two hearing devices L, R may renegotiate a connection and exchange information on connected aware auxiliary devices S and other network properties in order to merge the two networks smoothly, i.e. without the connected aware auxiliary devices S losing their connection to the network. A similar negotiation may take place in the event that the two hearing devices L, R become aware of each other for the first time since power-up. Information on connected aware auxiliary devices S may further be exchanged when a new aware auxiliary device S becomes connected to one of the hearing devices L, R. Similarly, if one of the hearing devices L, R is temporarily unable to perform its role in the combined network master, e.g. because the hearing device L, R is switched off, the respective other hearing device L, R continues to act as an independent network master as described above.

In general, the system 1 and some or all of the devices L, R, S, B may be adapted to relay messages 34, 36, 37, 42 between devices L, R, S, B as described in detail in the European patent application EP10186937.8 (see FIGS. 2 and 3 as well as the corresponding description on page 6, line 19 to page 13, line 3), which is hereby incorporated by reference.

The combined network master comprising the two hearing devices L, R controls the allocation of time slots 31 to the devices L, R, S, B in the network. The allocation may be changed dynamically in dependence on requests from the aware devices L, R, S, e.g. when one or more devices L, R, S has an increased or a decreased amount of data to transmit. Dynamic allocation may be achieved by switching between a number of fixed allocation schemes and/or by changing the number of time slots 31 per frame 32, the allocation of time slots 31 and/or the time slot duration Ts.

In the example basic allocation scheme shown in FIG. 3, smaller amounts of data from the hearing devices L, R are transmitted in "piggybacked" messages 36, which may be appended to individual beacon messages 34. Such beacon messages 34 include information about the piggybacked message 36 in order to avoid that other devices L, R, S transmit messages in the time slots 31 occupied by the piggybacked message 36. The remaining time slots 31 in the frame 32 may be used by other devices S, B to transmit data messages 37, 42.

Figure 4:
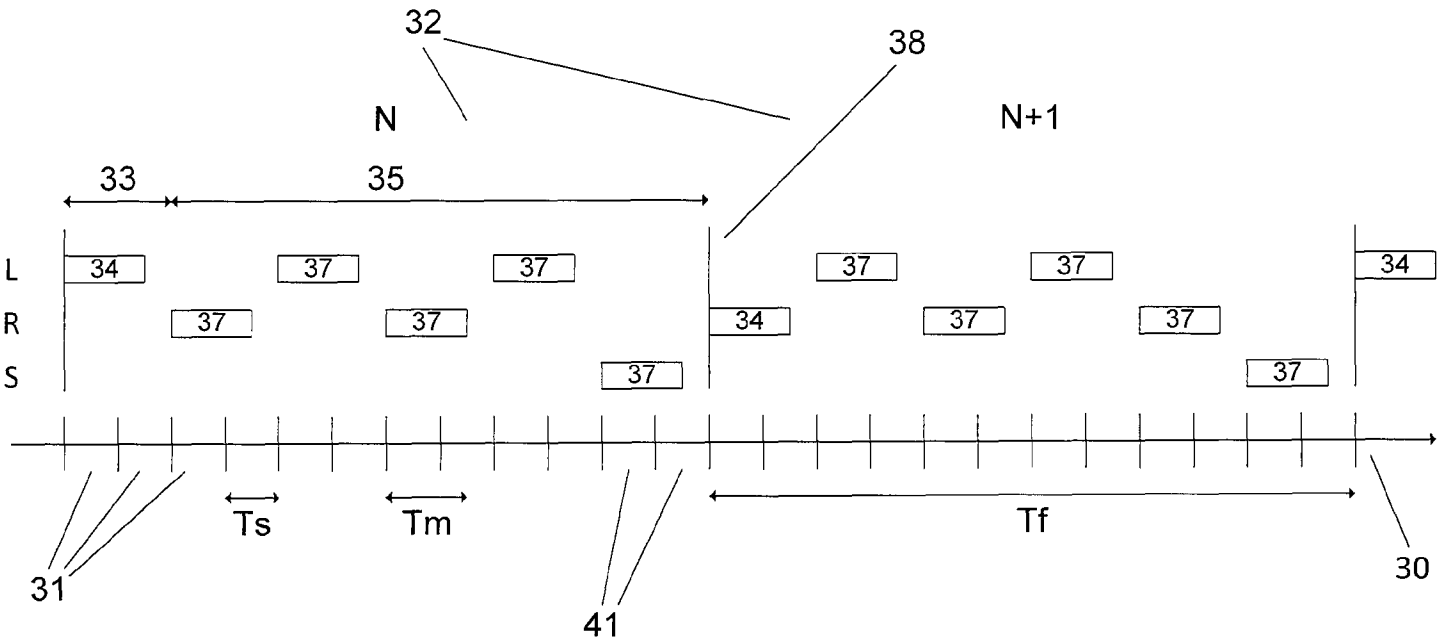
FIG. 4 shows a message sequence illustrating transmission of beacon messages and synchronous transmission of data messages in a second allocation scheme of the binaural hearing system of FIG. 2.

In the example "binaural burst" allocation scheme shown in FIG. 4, a larger amount of data, e.g. real-time audio signal data, is transmitted between the hearing devices L, R. Just extending the piggybacked messages 36 (see FIG. 3) to occupying the entire frame 32 would cause a delay in the audio data equal to at least the duration of the frame Tf, which is typically not acceptable for real-time audio streaming. Therefore, the time slots 31 in the frame portion 35 following the beacon interval 33 are allocated to data messages 37, each with a duration Tm substantially shorter than the duration of the frame Tf. As a general principle, messages 34, 37 from the two hearing devices L, R are transmitted in an alternating manner—also across frame boundaries 38. In order to achieve this, the particular hearing device L, R transmitting the beacon message 34 for a particular frame 32 is also the last hearing device L, R to transmit a data message 37 within that frame 32. Piggybacked messages 36 and specific network messages, such as acknowledgement (ACK) and non-acknowledgement (NAK) messages 39 (see FIG. 3) indicating respectively the successful and the non-successful reception of a message 36, 37, are excluded from the alternation.

In order to allow a quick transition from the basic allocation scheme shown in FIG. 3 to e.g. the binaural burst allocation scheme shown in FIG. 4, the time frame 32 of the basic allocation scheme comprises two listening intervals 40 (see FIG. 3) in which a respective hearing device L, R is allowed to transmit a request for changing the allocation scheme. This reduces the maximum latency for a change from about twice the duration of a frame Tf to a value substantially less than the duration of a single frame Tf.

Both in the basic allocation scheme shown in FIG. 3 and in the binaural burst allocation scheme shown in FIG. 4, specific time slots 41 in each frame 32 are reserved for aware auxiliary devices S. Within these reserved time slots 41, an aware auxiliary device S may transmit data messages 37, relayed messages and/or requests to change the allocation scheme in the event that the device S needs to transmit larger amounts of data, such as real-time audio data.

Since a broadcast device B cannot receive timing information from the combined network master L, R, broadcast messages 42 (see FIG. 3) from a broadcast device B may occur at any position within the frame 32, and this position may shift from frame 32 to frame 32. In order to avoid message collisions, the network master L, R therefore adapts the time scheme for the time slots 31 and the frames 32 when it detects broadcast messages 42 from a broadcast device B. In the adapted time scheme, specific time slots 43 are reserved for the broadcast messages 42. For simplicity, the broadcast messages 42 and the time slots 43 reserved for the broadcast messages 42 are not shown in FIG. 4, but may, nevertheless, be accommodated in the binaural burst allocation scheme and/or in any other allocation scheme. Due to possible differences in the used time bases in the different devices L, R, S, B, the network master L, R may further need to regularly make minor adjustments to the adapted time scheme. The adaptation of the time scheme may e.g. be achieved by applying a procedure similar to the procedures for adaptive change of frequency hopping schemes known from the Bluetooth standard. The master hearing device L, R—and thus the combined network master L, R—decides on a new timing scheme and then informs the other aware devices L, R, S in the network before actually applying the change. The information on the new timing scheme is transmitted to the aware devices L, R, S using a reliable protocol, i.e. a protocol that ensures that all devices L, R, S are informed before the change occurs. Such a protocol is also known from the Bluetooth standard. The above described adaptation of the time scheme in dependence on detecting broadcast messages 42 from a broadcast device B may alternatively be implemented and used in a prior art wireless system with only a single device acting as network master.

In order to reduce the effect of radio noise sources external to the system 1 and to allow coexistence of further similar systems 1 within the network range, an adaptive frequency hopping scheme is applied. The predefined frequency range is subdivided into a number of sub-ranges, and a specific algorithm is used to compute which frequency sub-range is to be used within each individual frame 32 for the transmission—and the reception—of messages 34, 36, 37, 39. Correspondingly, a frequency change is applied at each time frame boundary 38. The algorithm is implemented in all aware devices L, R, S and involves the use of a pseudo-random number generator, which takes an initial seed based on the frame's sequence number N. The system 1 may implement several different such algorithms. The choice of algorithm and the initial seed for the pseudo-random number generator is transmitted by the network master L, R to the aware devices L, R, S. Changes are applied similarly to the above described procedure for changing the timing scheme. Changes may be made, e.g. when detecting a disturbing radio source and/or when detecting shorter communication ranges within specific frequency sub-ranges.

In the binaural burst allocation scheme shown in FIG. 4 and/or in a similar allocation scheme used when transmitting real-time audio data from a streamer S, a different frequency hopping scheme may be applied to the data messages 37 comprising real-time audio, such that the frequency sub-band is changed before each data message 37. This allows for transmitting real-time audio data without infringing regulatory constraints concerning transmitted power within specific frequency bands. Also, the broadcast device B may implement its own, independent frequency hopping scheme, in which case the receiving devices L, R, S need to change their reception frequency for the corresponding reserved time slots 43 correspondingly.

The decision as to which allocation scheme to be used, or in the case that fixed schemes are not implemented, how to adapt the allocation scheme, may be taken by the master hearing device L, R alone or in cooperation with the slave hearing device L, R. The hearing device or hearing devices L, R may gather all relevant information from the devices L, R, S, B in the network and make the decision in dependence on this information.

Within each frame 32, an ACK or a NAK message 39 (see FIG. 3) may be transmitted immediately after the corresponding data message 36, 37 within the time slot 31 reserved for the data message 36, 37. Alternatively, one or more time slots 31 may be reserved for transmitting ACK and NAK messages 39 in reply to data messages 36, 37.

A device L, R, S may selectively choose not to transmit a data message 36, 37 in a time slot 31 reserved for that device L, R, S. The decision may e.g. depend on data received in one or more messages 34, 36, 37, 39 preceding the reserved time slot 31. For instance, a device L, R, S may transmit a message 36, 37 on a request from another device L, R, S, or it may retransmit a previously transmitted message 36, 37 or relay a previously received message 36, 37 in response to receiving a NAK-message 39 from another device L, R, S.

All or some of the messages 34, 36, 37, 39, 42 may comprise address information that allow a receiving device L, R, S to determine the intended receiver L, R, S and/or the sender L, R, S, B of the message 34, 36, 37, 39, 42. This allows for a more reliable communication. The address information may be local, i.e. unique within the system 1 only, or global, i.e. unique (or practically unique) for all systems 1. In the latter case, the network master L, R may ignore broadcast messages 42 from broadcast devices B which are not known to be part of the communication network. To further facilitate this, procedures for pairing a broadcast device B with a network master L, R may be implemented in the system 1. The network master L, R may alternatively regard an unknown broadcast device B as a radio noise source and change the frequency hopping scheme as described further above in dependence on receiving its broadcast messages 42.

The example allocation schemes shown in FIGS. 3 and 4 illustrate only a few features of preferred embodiments, and such features may be combined arbitrarily to arrive at workable allocation schemes. Determining the details of workable allocation schemes are considered to be within the capabilities of a person skilled in the art.

FEATURES AND ADVANTAGES OF PREFERRED EMBODIMENTS

The below described features of preferred embodiments of the invention may be combined arbitrarily with each other and/or with features mentioned above in order to adapt the system, the devices and/or the method according to the invention to specific requirements.

In a preferred embodiment of the invention, a binaural hearing system 1 comprises a left-ear hearing device L, a right-ear hearing device R and an auxiliary device S, each of the hearing devices L, R being arrangeable at or in a corresponding ear of an individual, the hearing devices L, R and the auxiliary device S being adapted to communicate with each other in a network by transmitting and receiving messages 34, 36, 37, 39, 42 within a predefined radio frequency range. The hearing system 1 comprises a network master L, R being adapted to repeatedly transmit beacon messages 34. The auxiliary device S has a connected mode wherein it transmits data messages 36, 37 and a disconnected mode wherein it does not transmit data messages 36, 37, and the auxiliary device S is adapted to enable the connected mode in dependence on receiving beacon messages 34, to synchronise its transmission of data messages 36, 37 with received beacon messages 34 and to enable the disconnected mode in dependence on not receiving beacon messages 34. Advantageously, the network master L, R comprises the left-ear hearing device L and the right-ear hearing device R, and the left-ear hearing device L and the right-ear hearing device R are adapted to alternatingly transmit the beacon messages 34.

Letting the hearing devices L, R cooperatively act as network master and further alternatingly transmit the beacon messages 34, allows for a more reliable and stable transmission of beacon messages 34 and thus for a more reliable network connection to auxiliary devices S, such that reconnection of auxiliary devices S will be required less frequently. This may improve the reliability and/or the efficiency of the communication.

In a further preferred embodiment of the invention, the auxiliary device S is adapted to enable the connected mode independently of which of the hearing devices L, R transmitted the received beacon messages 34. This may further improve the reliability and/or the efficiency of the communication.

In a further preferred embodiment of the invention, at least one of the hearing devices L, R is adapted to synchronise its transmission of beacon messages 34 with beacon messages 34 received from the respective other hearing device L, R. This allows for having one of the hearing devices L, R act as a master hearing device L, R that may resolve conflicts between the hearing devices L, R.

In a further preferred embodiment of the invention, the hearing system 1 further comprises a broadcast device B adapted to transmit broadcast messages 42 within the predefined radio frequency range, and the network master L, R is adapted to synchronise its transmission of beacon messages 34 with broadcast messages 42 received from the broadcast device B. This allows for allocating specific time slots 43 to transmissions from the broadcast device B, which may reduce the risk of message collisions in the network.

In a further preferred embodiment of the invention, at least one of the hearing devices L, R is adapted to change the rate of its transmission of beacon messages 34 in dependence on receiving beacon messages 34 from the respective other hearing device L, R. This allows for transmitting a beacon message 34 in each frame 32 independently of whether both or only one of the hearing devices L, R are present on the network.

In a further preferred embodiment of the invention, each of the hearing devices L, R is adapted to connect the auxiliary device S to the network by executing an initialisation procedure, to maintain a record of connected auxiliary devices S and to transmit information on connected auxiliary devices S to the respective other hearing device L, R. This allows for avoiding execution of the initialisation procedure when an auxiliary device S is already connected to one of the hearing devices L, R and thus allows for faster connecting of auxiliary devices S to both hearing devices L, R.

In a further preferred embodiment of the invention, the auxiliary device S is further adapted to relay network data received from one of the hearing devices L, R to the respective other hearing device L, R. This allows for maintaining synchronisation between the two hearing devices L, R when the hearing devices L, R are not able to communicate directly with each other.

In a further preferred embodiment of the invention, the predefined radio frequency range is subdivided into a number of frequency sub-ranges, and the beacon messages 34 are transmitted within changing frequency sub-ranges according to a frequency hopping scheme. By dividing the predefined frequency range into a number of frequency sub-bands and applying a scheme for repeatedly changing, which frequency band to transmit messages in, the impact on the system by disturbing narrowband signals may be reduced. This may further improve the reliability and/or the efficiency of the communication.

In a further preferred embodiment of the invention, a first hearing device L, R is arrangeable at or in an ear of an individual and is adapted to receive from a second hearing device L, R beacon messages 34 within a predefined radio frequency range. Advantageously, the first hearing device L, R is adapted to transmit beacon messages 34 within the predefined radio frequency range and alternatingly with the received beacon messages 34.

The first hearing device L, R may thus act as network master in cooperation with the second hearing device L, R, which allows for a more reliable and/or stable transmission of beacon messages 34 and thus for a more reliable network connection to auxiliary devices S.

In a further preferred embodiment of the invention, the first hearing device L, R is adapted to synchronise its transmission of beacon messages 34 with beacon messages 34 received from the second hearing device L, R. This allows for having the second hearing device L, R act as a master hearing device L, R that may resolve conflicts between the hearing devices L, R.

In a further preferred embodiment of the invention, an auxiliary device S is adapted to communicate with two hearing devices L, R by transmitting and receiving messages 34, 36, 37, 39, 42 within a predefined radio frequency range, the hearing devices L, R being arranged at or in corresponding ears of an individual and being adapted to alternatingly transmit beacon messages 34. The auxiliary device S has a connected mode wherein it transmits data messages 36, 37 and a disconnected mode wherein it does not transmit data messages 36, 37, and is adapted to enable the connected mode in dependence on receiving beacon messages 34, to synchronise its transmission of data messages 36, 37 with received beacon messages 34 and to enable the disconnected mode in dependence on not receiving beacon messages 34. Advantageously, the auxiliary device S is adapted to enable the connected mode independently of which of the hearing devices L, R transmitted the received beacon messages 34. This allows for a more reliable and/or stable reception of beacon messages 34 and thus for a more reliable network connection to the hearing devices L, R.

In a further preferred embodiment of the invention, the auxiliary device S is further adapted to relay network data and/or commands received from one of the hearing devices L, R to the respective other hearing device L, R. This allows for maintaining synchronisation between the two hearing devices L, R when the hearing devices L, R are not able to communicate directly with each other.

In a further preferred embodiment of the invention, a method for communicating within a predefined radio frequency range comprises: alternatingly transmitting beacon messages 34 by a left-ear hearing device L and a right-ear hearing device R each being arranged at or in a corresponding ear of an individual; receiving the beacon messages 34 by an auxiliary device S having a connected mode wherein it transmits data messages 36, 37 and a disconnected mode wherein it does not transmit data messages 36, 37; enabling the connected mode in dependence on the auxiliary device S receiving beacon messages 34; synchronising the transmission of data messages 36, 37 from the auxiliary device S with received beacon messages 34; and enabling the disconnected mode in dependence on the auxiliary device S not receiving beacon messages 34.

Letting the hearing devices L, R alternatingly transmit the beacon messages 34, allows for a more reliable and/or stable transmission of beacon messages 34 and thus for a more reliable network connection to auxiliary devices S, such that reconnection of auxiliary devices S will be required less frequently. This may improve the reliability and/or the efficiency of the communication.

Some preferred embodiments have been described in the foregoing, but it should be stressed that the invention is not limited to these, but may be embodied in other ways within the subject-matter defined in the following claims. For example, the features of the described embodiments may be combined arbitrarily.

It is further intended that the structural features of the system and/or devices described above, in the detailed description of 'mode(s) for carrying out the invention' and in the claims can be combined with the methods, when appropriately substituted by a corresponding process. Embodiments of the methods have the same advantages as the corresponding systems and/or devices.

Any reference numerals and names in the claims are intended to be non-limiting for their scope.

The invention claimed is:

1. A binaural hearing system, comprising:
a left-ear hearing device;
a right-ear hearing device; and
an auxiliary device,
each of the hearing devices being arrangeable at or in a corresponding ear of an individual,
the hearing devices and the auxiliary device being adapted to communicate with each other in a network by transmitting and receiving messages within a predefined radio frequency range,
the left-ear hearing device and the right-ear hearing device being adapted to alternatingly transmit beacon messages, the beacon messages comprising network data for control of the network, each of the beacon messages being transmitted at the start of a corresponding frame of the network,
the auxiliary device having a connected mode wherein it transmits data messages and a disconnected mode wherein it does not transmit data messages,
the auxiliary device being adapted
to enable the connected mode in dependence on receiving the beacon messages,
to synchronise its transmission of data messages with the received beacon messages, and
to switch from the connected mode to the disconnected mode in dependence on not receiving the beacon messages,
wherein each of the left-ear hearing device and the right-ear hearing device is configured
to connect the auxiliary device to the network by executing an initialization procedure,
to maintain a record indicating whether the auxiliary device is connected to the network through a respective one of the hearing devices, and
to transmit information indicating that said auxiliary device is connected to the network through the respective one of the hearing devices to the respective other hearing device.

2. A binaural hearing system according to claim 1, wherein the auxiliary device is adapted to enable the connected mode independently of which of the hearing devices transmitted the received beacon messages.

3. A binaural hearing system according to claim 1 or 2, wherein at least one of the hearing devices is adapted to synchronise its transmission of beacon messages with beacon messages received from the respective other hearing device.

4. A binaural hearing system according to claim 1, further comprising:
a broadcast device adapted to transmit broadcast messages within the predefined radio frequency range, wherein at least one of the left-ear hearing device and the right-ear hearing device is adapted to synchronise its transmission of beacon messages with the broadcast messages received from the broadcast device.

5. A binaural hearing system according to claim 1, wherein at least one of the hearing devices is adapted to change the rate of its transmission of beacon messages in dependence on receiving beacon messages from the respective other hearing device.

6. A binaural hearing system according to claim 1, wherein the auxiliary device is further adapted to relay network data received from one of the hearing devices to the respective other hearing device.

7. A binaural hearing system according to claim 1, wherein the predefined radio frequency range is subdivided into a number of frequency sub-ranges and wherein the beacon messages are transmitted within changing frequency sub-ranges according to a frequency hopping scheme.

8. A first hearing device configured to be a part of a binaural hearing system, the binaural hearing system further comprising a second hearing device and an auxiliary device,
the first hearing device being arrangeable at or in an ear of an individual,
the first hearing device being adapted to receive from the second hearing device beacon messages within a predefined radio frequency range, wherein
the first hearing device is adapted to transmit beacon messages within the predefined radio frequency range and alternatingly with the received beacon messages, the beacon messages comprising network data for control of the network, each of the beacon messages being transmitted at the start of a corresponding frame of the network,
each of the first hearing device and the second hearing device is configured
to connect the auxiliary device to the network by executing an initialization procedure,
to maintain a record indicating whether the auxiliary device is connected to the network through a respective one of the hearing devices, and
to transmit information indicating that said auxiliary device is connected to the network through the respective one of the hearing devices to the respective other hearing device.

9. A first hearing device according to claim 8 and further being adapted to synchronise its transmission of beacon messages with beacon messages received from the second hearing device.

10. A method for communicating within a predefined radio frequency range, the method comprising:
alternatingly transmitting beacon messages by a left-ear hearing device and a right-ear hearing device, each being arranged at or in a corresponding ear of an individual, the beacon messages comprising network data for control of the network, each of the beacon messages being transmitted at the start of a corresponding frame of the network;
receiving the beacon messages by an auxiliary device having a connected mode wherein it transmits data messages and a disconnected mode wherein it does not transmit data messages;
enabling the connected mode in dependence on the auxiliary device receiving the beacon messages;
synchronising the transmission of the data messages from the auxiliary device with the received beacon messages;
switching from the connected mode to the disconnected mode in dependence on the auxiliary device not receiving the beacon messages;

connecting the auxiliary device to the network by executing an initialization in each of the left-ear hearing device and the right-ear hearing device;

maintaining a record indicating whether the auxiliary device is connected to the network through a respective one of the hearing devices in each of the left-ear hearing device and the right-ear hearing device; and transmitting information indicating that said auxiliary device is connected to the network through the respective one of the hearing devices from one of the left-ear hearing device and the right-ear hearing device to the respective other hearing device.

* * * * *